United States Patent [19]

Cumbo

[11] 4,324,625

[45] Apr. 13, 1982

[54] PROCESS FOR PREPARING ALKANEDIOLS BY ELECTROCHEMICAL COUPLING OF HALOHYDRINS

[75] Inventor: Charles C. Cumbo, Wilmington, Del.

[73] Assignee: E. I. Du Pont de Nemours and Company, Wilmington, Del.

[21] Appl. No.: 171,380

[22] Filed: Jul. 29, 1980

Related U.S. Application Data

[63] Continuation-in-part of Ser. No. 67,351, Aug. 14, 1979, abandoned.

[51] Int. Cl.[3] ..... C25B 3/10; C25B 11/04; C25B 13/08

[52] U.S. Cl. ..... 204/72; 204/59 R; 204/73 R

[58] Field of Search ..... 204/72, 73 R, 81

[56] References Cited

U.S. PATENT DOCUMENTS

| | | | |
|---|---|---|---|
| 3,399,124 | 8/1968 | Gilch | 204/72 |
| 3,692,569 | 9/1972 | Grot | 428/320 |
| 3,784,399 | 1/1974 | Grot | 428/213 |
| 3,876,514 | 4/1975 | Baizer | 204/59 R |
| 3,925,135 | 12/1975 | Grot | 204/296 X |
| 4,097,344 | 6/1978 | Drury | 204/59 R |
| 4,098,657 | 7/1978 | Kay et al. | 204/59 R |
| 4,253,921 | 3/1981 | Baldwin et al. | 204/72 |

FOREIGN PATENT DOCUMENTS

| | | | |
|---|---|---|---|
| 805142 | 1/1969 | Canada | 204/73 R |
| 9603 | of 1909 | United Kingdom | 204/72 |
| 1145372 | 3/1969 | United Kingdom | 204/72 |

OTHER PUBLICATIONS

Cipris, J. Applied Electrochem, vol. 8, pp. 537–544, (1978).

Allen, Organic Electrode Processes, p. 91, Pub. by Chapman & Hall Ltd., London, (1958).

Cornforth, et al, J. Chem. Soc. C 1970 (6) 596–599.

*Primary Examiner*—F. Edmundson

[57] ABSTRACT

The invention relates to a process for the preparation of alkanediols by the electrochemical coupling of a halohydrin in a divided electrolytic cell having a copper cathode, in an aqueous system whose catholyte contains copper ions and a ligand.

14 Claims, No Drawings

PROCESS FOR PREPARING ALKANEDIOLS BY ELECTROCHEMICAL COUPLING OF HALOHYDRINS

CROSS-REFERENCE TO RELATED APPLICATION

This application is a continuation-in-part of application Ser. No. 06/067,351, filed Aug. 14, 1979, now abandoned.

DESCRIPTION

Technical Field

This invention relates to a process for preparing alkanediols. It is more particularly directed to a process for preparing alkanediols by the electrochemical coupling of halohydrins.

Background Art 1,4-Butanediol (BAD) is a commodity in the chemical industry, widely used as a solvent, as a reactant in the manufacture of plastics and as an intermediate in the manufacture of tetrahydrofuran.

One of the commonly used methods for preparing BAD commercially is the catalytic reaction of acetylene and formaldehyde to form 1,4-butynediol, followed by hydrogenation of the butynediol to BAD. While this method has been generally satisfactory in the past, it is not as highly regarded as it once was because acetylene is becoming increasingly expensive and because the process requires large amounts of energy.

The electrochemical coupling of halohydrins would appear to be an attractive route to BAD because the ultimate starting material for the process is ethylene, a cheaper commodity than acetylene, and because the only energy requirement is a moderate amount of electric current. An attempt at the electrochemical coupling of 2-chloroethanol, 2-bromoethanol and 2-iodoethanol to form BAD was reported by D. Cipris in *Journal of Applied Electrochemistry,* 8(1978), 537–544. That attempt was described as unsuccessful, yielding only unstable intermediates which decomposed to ethylene and hydroxyl ions.

Disclosure of the Invention

It has now been found that BAD can be prepared in good yield, in one step and with only moderate expenditure of energy, by the electrochemical coupling of a halohydrin if the coupling is carried out in a divided electrolytic cell having a copper cathode, in an aqueous system whose catholyte contains copper ions and a stabilizing ligand.

The process of the invention is carried out in a conventional two-chamber electrolytic cell. In the cathode chamber is a catholyte which is an aqueous solution containing a halohydrin, an electrolyte, a stabilizing ligand and copper ions. The anolyte in the anode chamber is an aqueous solution of an iodide or bromide and an electrolyte. The catholyte is separated from the anolyte by a diaphragm which prevents migration of molecules from one to the other but permits the passage of electrolyte cations, and which is also electroconductive and inert to the cell contents. The cell cathode is of copper. When direct electric current is passed through the cell, alkanediol collects in the catholyte and can be recovered.

Although fritted glass discs can be used as diaphragms in small scale operations, diaphragms comprising those strongly acidic cationic ion-exchange resins which can satisfy the physical requirements just mentioned are preferred. A resin of this type preferred for use is a homopolymer of an ethylenically unsaturated monomer (A) containing groups such that the final polymer will contain groups of the formula

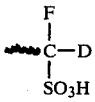

(1)

or

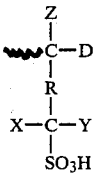

(2)

where

~ represents the polymer chain or a segment thereof;

D is hydrogen, an aliphatic or aromatic hydrocarbon radical of 1–10 carbon atoms, a halogen or a segment of the polymer chain;

X and Y are hydrogen, a halogen or an aliphatic or aromatic hydrocarbon radical of 1–10 carbon atoms, but at least one must be fluorine;

R is a linear or branched linking group having up to 40 carbon atoms in the principal chain;

and

Z is hydrogen, a halogen or an aliphatic or aromatic hydrocarbon radical of 1–10 carbon atoms, or a copolymer of monomer (A) with at least one other copolymerizable ethylenically unsaturated monomer (B).

The linking group defined by R in formula (2) can be a homogeneous one such as an alkylene radical, or it can be a heterogeneous one such as an alkylene ether radical. In the preferred resins, this linking radical contains 1–20 carbon atoms in the principal chain. In the especially preferred resin, R is a radical of the structure

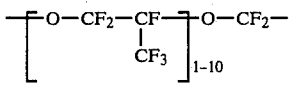

Illustrative of monomer (A) are such monomers as trifluorovinyl sulfonic acid, linear or branched chain vinyl monomers containing sulfonic acid group precursors and perfluoroalkylvinyl ethers containing sulfonic acid group precursors.

Illustrative of monomer (B) are such monomers as ethylene, styrene, vinyl chloride, vinyl fluoride, vinylidene fluoride, chlorotrifluoroethylene (CTFE), bromotrifluoroethylene (BTFE), vinyl ethers, perfluoroalkyl vinyl ethers, butadiene, tetrafluoroethylene (TFE) and hexafluoropropylene (HFP).

The homopolymerization and copolymerization can be done according to the procedures described in U.S. Pat. No. 3,784,399 to Grot, and the patents cited therein. Monomer ratios are selected to give the resulting polymer the proper equivalent weight.

The resins have equivalent weights of 950–1,500, preferably 1,100–1,300. Equivalent weight of a resin is that weight in grams which contains one gram equivalent weight of sulfonic acid groups, and can be determined by titration.

The resins should be effectively free of functional groups, other than $—SO_3H$ groups, which might interfere with the electrochemical coupling reaction. "Effectively free" means the resin may contain a small number of such groups, but not so many that the reaction is affected adversely or the product contaminated.

Resins whose polymer chains are of perfluorocarbon monomers are preferred for use in diaphragm materials. Illustrative of such monomers are TFE, HFP, CTFE, BTFE and perfluoroalkyl vinyl ethers. Mixtures of monomers can also be used.

Even more preferred as resins are copolymers of TFE or CTFE and a perfluoroalkyl vinyl ether containing sulfonic acid group precursors. Most preferred in this class are copolymers of TFE or CTFE and a monomer represented by the structure

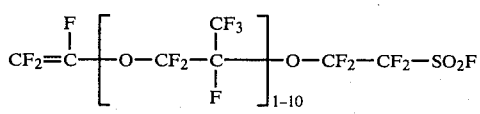

(3)

These copolymers are prepared in the sulfonyl fluoride form and are then hydrolyzed to the acid form as described in U.S. Pat. No. 3,692,569 to Grot.

Most preferred resins are copolymers of TFE and monomers of formula (3) in which the respective monomer unit weight ratios are 50-75/25-50. Such copolymers, having equivalent weights of 1100, 1150 and 1500, are solt by E. I. du Pont de Nemours and Company as Nafion® perfluorosulfonic acid resins.

An especially preferred material for use as a diaphragm is one sold by E. I. du Pont de Nemours and Company as Nafion® perfluorosulfonic acid membrane.

The thickness of the diaphragm material, and its porosity, are limited only by practical considerations, so long as the previously mentioned requirements of conductivity and ability to prevent molecules from migrating from one chamber of the cell to the other while still permitting the passage of electrolyte cations are observed. The choice regarding thickness and porosity can be made easily by anyone skilled in this art.

The electrodes of the electrolytic cell can be any convenient shape. For example, they can be in the form of rods, strips, sheets, coils or mesh. Their locations in the chambers are of secondary importance, although the cell's efficiency is improved if the electrodes are places as close together as possible. Electrode size bears a direct relationship to the cell's volume and should be such that the electrode surface area/cell volume ratio is 0.7–8 $cm^2/cm^3$, preferably 5.9–8 $cm^2/cm^3$.

The cathode of the cell must be copper. The only requirement for the anode is that it be conductive and inert to the system in the sense that it does not oxidize. Noble metals are therefore preferred, and platinum is most preferred.

The catholyte of the cell is, as previously mentioned, an aqueous solution of (1) a halohydrin, (2) a compound which can provide copper ions, (3) a stabilizing ligand and (4) an electrolyte.

The halohydrin can be any represented by the structure $$HO—R—X$$

where

R is an alkylene radical of 2–4 carbon atoms and

X is bromine or iodine.

Preferred for use are 2-iodoethanol, 2-bromoethanol and 1-iodo-2-propanol. 2-Iodoethanol is most preferred because it gives the best yield of BAD.

The halohydrin is present in the catholyte at a concentration of 0.1–4.0 moles per liter, preferably 0.2–2.7 moles.

The halohydrins can be prepared by reacting ethylene and iodine or bromine, as described by J. W. Cornforth and D. T. Green in J. Chem. Soc. C 1970 (6) 846–849, and in British Pat. No. 1,159,224.

In the present process, iodine or bromine forms at the anode of the cell. This can be recovered and reacted with ethylene according to the Cornforth-Green process to form a halohydrin, which can then be used to replenish that being consumed in the catholyte. When this is done, the practical or net process of the invention can be represented by the equation $$X_2+H_2O+\tfrac{1}{2}O_2+2CH_2{=}CH_2\rightarrow 2XCH_2—CH_2—O-$$
$$H2XCH_2—CH_2—OH+2e\rightarrow HOCH_2CH_2CH_2C-$$
$$H_2OH+2X^{31}\ 2X^-\rightarrow X_2+2e$$

where X is iodine or bromine. This means that the process can be run as a virtually closed loop, the only inputs being ethylene, electric current and occasional replenishment of electrolyte and halide.

Copper, as $Cu^{+1}$ or $Cu^{+2}$ ions, must be present in the catholyte for the process of the invention to function. These ions can be derived from any copper compound which can dissociate enough in the system to provide the requisite number of ions and whose anion does not interfere with the electro-coupling reaction. Illustrative are the halides, nitrates, acetates and sulfates. Copper ions are present in the catholyte at a concentration of 0.0001–0.01 mole per liter, preferably 0.001–0.008 mole.

The copper ions in the catholyte must be stabilized with a ligand. Any ligand which can stabilize copper ions under cell conditions and which does not interfere with the electro-coupling reaction can be used. Illustrative are ammonia, thiourea, ethylenediamine and primary, secondary and tertiary amines. Ammonia and thiourea are preferred. The ligand is present in the catholyte at a concentration of 0.01–1.0 mole per liter, preferably 0.05–0.2 mole.

The sole function of the electrolyte in the catholyte, and in the anolyte as well, is to make the cell contents electroconductive. Any water-soluble compound which can accomplish this without interfering with the electro-coupling reaction can be used. Illustrative are the ammonium and alkali metal chlorides, iodides, bromides, nitrates and hydroxides and zinc bromide. Ammonium salts, especially ammonium nitrate, are preferred.

The electrolyte is present in the catholyte at a concentration of 1–6 moles per liter, preferably 1.5–2.0 moles.

As previously mentioned, the anolyte is an aqueous solution containing an iodide or bromide and and electrolyte. Any compound which can provide $I^-$ or $Br^-$ ions under cell conditions and which does not interfere with the electro-coupling reaction can be used. Illustrative are the ammonium and alkali metal halides. Ammonium iodide is preferred.

The iodide or bromide is present in the anolyte at a concentration of 0.1–4.0 moles per liter, preferably 0.2–2.7 moles per liter.

The electrolyte in the anolyte can be any of those previously listed for use in the catholyte. As a matter of fact, it is preferred that the anolyte electrolyte be the same as that in the catholyte, and that it be present at the same concentration.

The process of the invention can be carried out batchwise or in a continuous fashion. In the batch operation, the cell is charged with suitable anolyte and catholyte and passage of direct current through the cell is begun. When a predetermined level of conversion of halohydrin to alkanediol has been obtained, the current is turned off and alkanediol is recovered from the catholyte. The time required for any particular level of conversion to be reached can be easily calculated by one skilled in this art from the amount of current used.

Alkanediol can be recovered from the catholyte by extracting it with 1-butanol. It may sometimes be desirable to add salts, such as NaCl, which lower the solubility of the alkanediol in the catholyte. The butanol is then stripped from the extract by heating the extract under vacuum, and the residue fractionated by conventional techniques to give alkanediol product and halohydrin, which can be recycled to the catholyte if desired.

When run continuously, the process is much the same. The catholyte is continuously circulated and replenished with halohydrin, while alkanediol is continuously removed by conventional engineering techniques. Similarly, the anolyte is continuously circulated and replenished with an iodide or bromide, while elemental iodine or bromine is removed by filtration or extraction. This iodine or bromine can be separately converted to the corresponding halohydrin by reacting it with ethylene, as previously described. This halohydrin can then be used to replenish the catholyte.

When run continuously or batchwise, the cell contents are held at a temperature of 0°–50° C., preferably 10°–30° C. Temperature varies with the current being applied and the internal resistance of the cell and heating or cooling may be required to hold the temperature at any given level.

The pressure at which the process is run is ordinarily ambient, although somewhat higher or lower pressures can be used if desired.

The pH of the catholyte is preferably kept below about 8 to minimize the degradation of halohydrin to ethylene oxide, an undesirable reaction.

In both the continuous and batch mode, the process is ordinarily run at an electrode potential (relative to a standard calomel electrode) of about −0.7 to about −1.2 volts, preferably about −1.01 to about −1.03 volts, at a current density of 0.001–1.0 ampere per square centimeter of electrode, preferably 0.04–0.06 ampere per square centimeter.

EXAMPLES

The processes described in the following examples were performed in a conventional divided electrolytic cell having the following specifications:

| | |
|---|---|
| Volume of each chamber | 300 ml |
| Diaphragm material | Nafion ® perfluorosulfonic acid membrane 427 |
| Cathode | copper mesh - total surface area of 17.4 $cm^2$ |
| Anode | platinum foil - frontal surface area of 6 $cm^2$ |
| Distance between anode and cathode | 9.0 cm |

The cell was equipped with a standard calomel electrode and means for stirring its contents and for maintaining them at constant temperature.

Example 1—Best Mode

The cathode chamber of the cell was charged with 150 ml of 2.0 M ammonium nitrate and 17.2 g of 2-iodoethanol, and the anode chamber with 150 ml of 2.0 M ammonium nitrate and 13.5 g of ammonium iodide. The cathode chamber was then purged with nitrogen and 1.5 ml of a solution containing 1.53 g of CuCl, 17 ml of water and 8 ml of concentrated $NH_4OH$ was added to the catholyte.

Direct current was then applied to the cell at a constant potential of −1.03 volts (relative to the standard calomel electrode) until 0.0442 moles of electrons had passed through the cell. During electrolysis, the catholyte was continuously replenished by the addition of the aforementioned $Cu^{+1}$ solution at the rate of 1.6 ml per hour, and the temperature of the anolyte and catholyte was held at about 21° C.

Twenty-five grams of sodium chloride were added to the catholyte, which was then treated with 50 ml of 1-butanol in a continuous extractor to give 1.09 g of 1,4-butanediol.

Example 2

The cathode chamber of the cell was charged with 140 ml of 2.0 M ammonium chloride, 0.08 g of cupric chloride dihydrate, 1.0 ml of 15 M ammonium hydroxide and 17.3 g of 1-iodo-2-propanol and the anode chamber with 140 ml of 2.0 M ammonium chloride and 13.5 g of ammonium iodide.

Direct current was then applied to the cell at a constant potential of −1.10 volts (relative to the standard calomel electrode) until 0.036 moles of electrons had passed through the cell.

The catholyte was then treated as shown in Example 1, to give 0.875 g of 2,5-hexanediol.

Example 3

An electrolysis was performed as shown in Example 2, but using 11.6 g of 2-bromoethanol instead of 1-iodo-2-propanol, and using a potential of −1.03. The electrolysis was continued until 0.039 moles of electrons had passed through the cell.

The catholyte was then treated as shown in Example 1, to give 0.323 g of 1,4-butanediol.

INDUSTRIAL APPLICABILITY

The process of the invention can be used to prepare 1,4-butanediol, widely used as an industrial solvent, as a reactant in the manufacture of plastics and as an intermediate in the manufacture of tetrahydrofuran.

I claim:

1. A process for preparing an alkanediol from a halohydrin represented by the structure

HO—R—X where

R is an alkylene radical of 2–4 carbon atoms and

X is iodine or bromine, the process comprising (A) passing a direct electric current through a divided electrolytic cell having a copper cathode and having (1) a cathode compartment containing a catholyte which is an aqueous solution comprising (a) the halohydrin, (b) an electrolyte (c) 0.01–1 mole per liter of a stabilizing ligand, and (d) copper ions, and (2) an anode compartment containing an anolyte which is an aqueous solution comprising (e) an iodide or bromide and (f) an electrolyte, the cathode compartment being separated from the anode compartment by an electroconductive diaphragm permeable to electrolyte cations; and (b) recovering alkanediol from the catholyte.

2. The process of claim 1 in which the diaphragm comprises a homopolymer of an ethylenically unsaturated monomer (A) containing groups such that the final polymer will contain groups of the formula

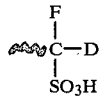

or

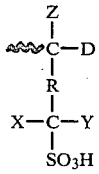

where represents the polymer chain or a segment thereof;

D is hydrogen, an aliphatic or aromatic hydrocarbon radical of 1–10 carbon atoms, a halogen or a segment of the polymer chain;

X and Y are hydrogen, halogen or an aliphatic or aromatic hydrocarbon radical of 1–10 carbon atoms, but at least one of X or Y must be fluorine;

R is a linear or branched linking group having up to 40 carbon atoms in the principal chain; and Z is hydrogen, halogen or an aliphatic or aromatic hydrocarbon radical of 1–10 carbon atoms; or a copolymer of monomer (A) with at least one other copolymerizable ethylenically unsaturated monomer (B).

3. The process of claim 2 in which the diaphragm comprises a copolymer of monomer (A) and a perfluorocarbon monomer.

4. The process of claim 3 in which the diaphragm comprises a copolymer of tetrafluoroethylene or chlorotrifluoroethylene and a monomer represented by the structure

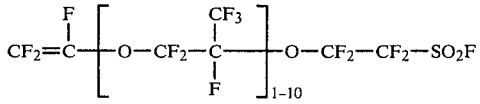

the tetrafluoroethylene or chlorotrifluoroethylene and monomer units being present in weight ratios of 50–75/-25–50, respectively, the copolymer being hydrolyzed to the acid form.

5. The process of claim 1 having the additional step of recovering elemental iodine or bromine from the anolyte, reacting it with ethylene to form a halohydrin and then using the halohydrin to replenish the catholyte.

6. The process of claim 1 in which the halohydrin is 2-iodoethanol.

7. The process of claim 1 in which the halohydrin is 2-bromoethanol.

8. The process of claim 1 in which the electrolyte in the anolyte and catholyte is ammonium nitrate.

9. The process of claim 1 in which the iodide in the anolyte is ammonium iodide.

10. The process of claim 1 in which the ligand is ammonia.

11. The process of claim 1 in which the ligand is thiourea.

12. A process for preparing 1,4-butanediol from 2-iodoethanol, the process comprising (A) passing a direct electric current through a divided electrolytic cell having a copper cathode and having a cathode compartment containing a catholyte which is an aqueous solution comprising 2-iodoethanol, ammonium nitrate, $Cu^{+1}$ ions and a stabilizing ligand, and an anode compartment containing an anolyte which is an aqueous solution comprising ammonium iodide and ammonium nitrate, the cathode compartment being separated from the anode compartment by a diaphragm of the material described in claim 4; and (B) recovering 1,4-butanediol from the catholyte.

13. The process of claim 12 having the additional step of recovering elemental iodine from the anolyte, coverting it to 2-iodoethanol by reaction with ethylene and then using the 2-iodoethanol to replenish the catholyte.

14. An electrolytic cell comprising (A) an anode and a copper cathode; and (B) an anode chamber and a cathode chamber, separated by the material described in claim 2, the anode chamber containing an aqueous solution comprising (1) an iodide or bromide, and (2) an electrolyte, and the cathode chamber containing an aqueous solution comprising (1) a halohydrin, represented by the structure

HO—R—X where R is an alkylene radical of 2–4 carbon atoms and X is iodine or bromine, (2) an electrolyte, (3) 0.01–1.0 mole per liter of a stabilizing ligand and (4) copper ions.

* * * * *